US008181490B2

(12) United States Patent
Sinykin

(10) Patent No.: US 8,181,490 B2
(45) Date of Patent: May 22, 2012

(54) VACUUM SEALED PAINT ROLLER COVER PACKAGE AND METHOD OF MAKING THE SAME

(75) Inventor: Daniel L. Sinykin, River Hills, WI (US)

(73) Assignee: Seamless Technologies. LLC, Janesville, WI (US)

( * ) Notice: Subject to any disclaimer, the term of this patent is extended or adjusted under 35 U.S.C. 154(b) by 374 days.

(21) Appl. No.: 12/698,657

(22) Filed: Feb. 2, 2010

(65) Prior Publication Data

US 2010/0126893 A1 May 27, 2010

Related U.S. Application Data

(63) Continuation-in-part of application No. 12/643,724, filed on Feb. 21, 2009, which is a continuation of application No. 12/371,009, filed on Feb. 13, 2009, now Pat. No. 7,634,724, which is a continuation-in-part of application No. 11/871,307, filed on Oct. 12, 2007, now Pat. No. 7,503,190, and a continuation-in-part of application No. 12/257,815, filed on Oct. 24, 2008, and a continuation-in-part of application No. 12/258,036, filed on Oct. 24, 2008, and a continuation-in-part of application No. 12/257,039, filed on Oct. 23, 2008, and a continuation-in-part of application No. 12/132,774, filed on Jun. 4, 2008, and a continuation-in-part of application No. 12/116,022, filed on May 6, 2008, now Pat. No. 7,748,980, application No. 12/698,657, which is a continuation-in-part of application No. 11/740,119, filed on Apr. 25, 2007, now Pat. No. 7,503,191, and a continuation-in-part of application No. 12/100,050, filed on Apr. 9, 2008, and a continuation-in-part of application No. 12/015,612, filed on Jan. 17, 2008, now Pat. No. 7,905,980, which is a continuation of application No. 11/871,307, which is a continuation-in-part of application No. 11/740,119.

(60) Provisional application No. 12/698,657.

(51) Int. Cl.
*D04B 11/08* (2006.01)

(52) U.S. Cl. ..... 66/191; 66/194

(58) Field of Classification Search ..... 66/191, 66/195, 194, 190, 9 R–12
See application file for complete search history.

(56) References Cited

U.S. PATENT DOCUMENTS

| | | | |
|---|---|---|---|
| RE34,929 | E | 5/1995 | Kristen |
| 2008/0190512 | A1 | 8/2008 | Borchardt |
| 2008/0251406 | A1 | 10/2008 | Ardito |
| 2008/0264110 | A1 | 10/2008 | Sinykin |
| 2009/0088307 | A1 | 4/2009 | Jelinek et al. |

*Primary Examiner* — Larry Worrell, Jr.
(74) *Attorney, Agent, or Firm* — Reinhart Boerner Van Deuren s.c.

(57) ABSTRACT

A compactly packaged paint roller cover and a method of compactly packaging a paint roller cover are disclosed which require significantly reduced shipping and display shelf space volumes. A semi-rigid paint roller cover manufactured from a small diameter tubular knitted pile fabric is placed within a vacuum sealable plastic bag, which is subsequently evacuated and sealed, collapsing the semi-rigid paint roller cover to a flattened configuration. Such compactly packaged paint roller covers require significantly reduced shipping and display shelf space volumes. To use the compactly packaged paint roller cover, the vacuum sealed plastic bag is opened upon which the semi-rigid paint roller cover resiliently resumes its round cross-section.

20 Claims, 7 Drawing Sheets

FIG. 9
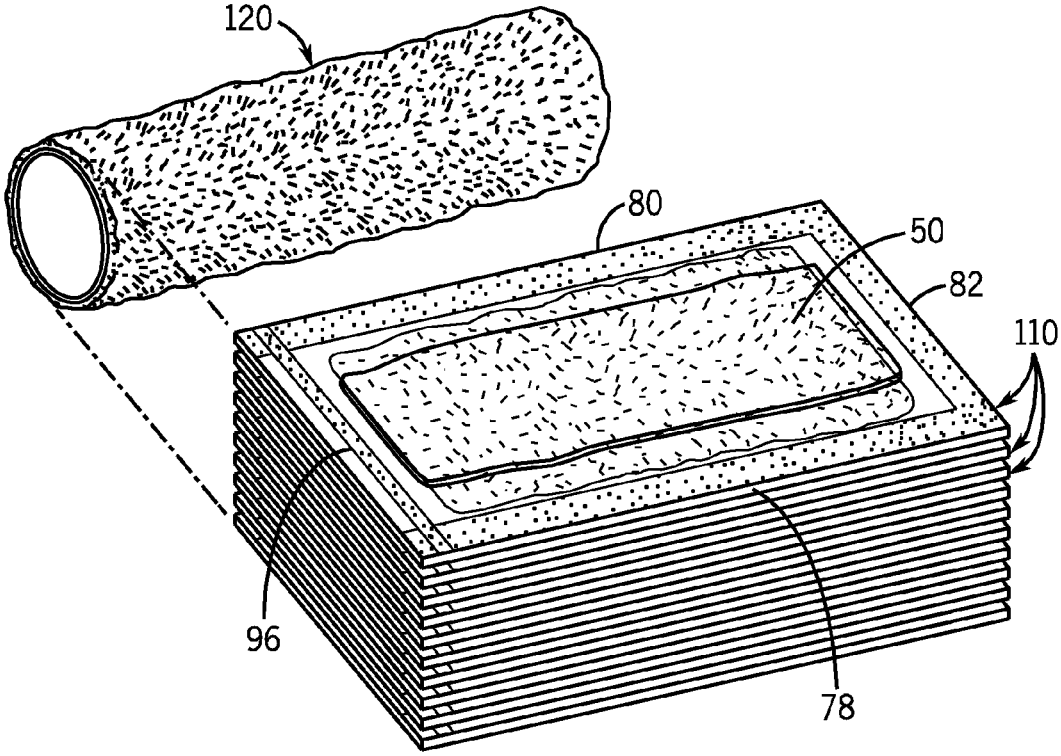
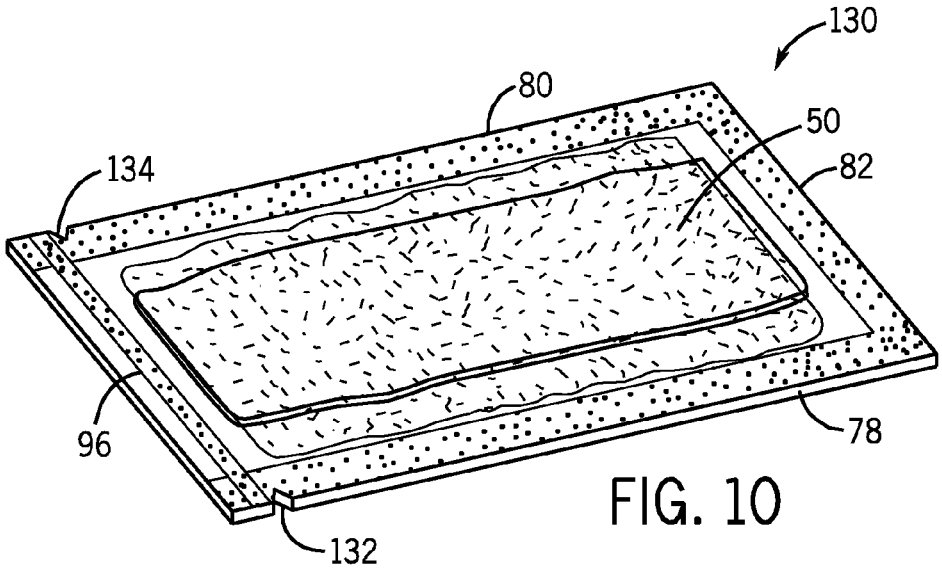
FIG. 10

VACUUM SEALED PAINT ROLLER COVER PACKAGE AND METHOD OF MAKING THE SAME

IDENTIFICATION OF RELATED APPLICATIONS

This patent application is: a. a continuation-in-part of U.S. patent application Ser. No. 12/116,022, filed on May 6, 2008, now U.S. Pat. No. 7,748,241, entitled "Tubular Cut Pile Knit Fabric for Paint Roller Covers," which is in turn a continuation-in-part of U.S. patent application Ser. No. 11/740,119, filed on Apr. 25, 2007, now U.S. Pat. No. 7,503,191, issued on Mar. 17, 2009, entitled "Tubular Sliver Knit Fabric for Paint Roller Covers;" b. a continuation-in-part of U.S. patent application Ser. No. 12/015,612, filed on Jan. 17, 2008, now U.S. Pat. No. 7,905,980, entitled "Method of Manufacturing Paint Roller Covers From a Tubular Fabric Sleeve;" c. a continuation-in-part of copending U.S. patent application Ser. No. 12/100,050, filed on Apr. 9, 2008, entitled "Method of Manufacturing Paint Roller Covers From a Tubular Fabric Sleeve;" d. a continuation-in-part of copending U.S. patent application Ser. No. 12/132,774, filed on Jun. 4, 2008, entitled "Method of Manufacturing Paint Roller Covers From a Tubular Fabric Sleeve;" e. a continuation-in-part of copending U.S. patent application Ser. No. 12/257,039, filed on Oct. 23, 2008, entitled "Methods of Manufacturing Paint Roller Covers From a Tubular Fabric Sleeve;" f. a continuation-in-part of copending U.S. patent application Ser. No. 12/258,036, filed on Oct. 24, 2008, entitled "Methods of Manufacturing Paint Roller Covers From a Tubular Fabric Sleeve;" g. a continuation-in-part of copending U.S. patent application Ser. No. 12/257,815, filed on Oct. 24, 2008, entitled "Methods of Manufacturing Paint Roller Covers From a Tubular Fabric Sleeve;" and h. a continuation-in-part of copending U.S. patent application Ser. No. 12/643,724, filed on Feb. 21, 2009, entitled "Methods of Manufacturing Paint Roller Covers From a Tubular Fabric Sleeve," which is a continuation of U.S. patent application Ser. No. 12/371,009, filed on Feb. 13, 2009, now U.S. Pat. No. 7,634,724, issued on Dec. 22, 2009, entitled "Forming a Tubular Knit Fabric for a Paint Roller Cover," which is in turn a continuation of U.S. patent application Ser. No. 11/871,307, filed on Oct. 12, 2007, now U.S. Pat. No. 7,503,190, issued on Mar. 17, 2009, entitled "Forming a Tubular Knit Fabric for a Paint Roller Cover," all eight of which patent applications or patents are assigned to the assignee of the present invention, and all eight of which patent applications or patents are hereby incorporated herein by reference in their entirety.

BACKGROUND OF THE INVENTION

Field of the Invention

The present invention relates generally to paint roller covers, and more particularly to a compactly packaged paint roller cover and a method of compactly packaging a paint roller cover.

The two inventions which have had the greatest impact on paint application are the invention of the paint roller in the 1930's and the development of water-based paint in the late 1940's. While water-based paints are easy to mix, apply, and clean up, there is little doubt that the paint roller has been the greatest single time saving factor in the paint application process, allowing large surfaces to be painted with a uniform coat of paint quickly and easily. Typically, paint rollers are comprised of two components, namely a handle assembly and a paint roller cover for installation onto the handle assembly.

The handle assembly consists of a grip member having a generally L-shaped metal frame extending therefrom, with the free end of the metal frame having a rotatable support for a paint roller cover mounted thereon. The paint roller cover consists of a thin, hollow cylindrical core which fits upon the rotatable support of the handle, with a plush pile fabric being secured to the outer diameter of the paint roller cover. The core may be made of either cardboard or plastic material, with which material is used for the core generally being determined based upon the selling price of the paint roller cover. The pile fabric is traditionally applied as a strip which is helically wound onto the outer surface of the core with adjacent windings of the fabric strip being located close adjacent each other to provide the appearance of a single continuous pile fabric covering on the core.

Typically, the pile fabric is a dense knitted pile fabric, which may be knitted from natural fibers such as wool or mohair, synthetic fibers such as polyester, acrylic, nylon, or rayon, polypropylene or from a blend of natural and synthetic fibers. The knitting is typically performed on a circular sliver knitting machine, which produces a tubular knitted backing or base material with a pile knit on the inside of the tubular segments which are approximately fifty-eight inches (1473 millimeters) in circumference by thirty to fifty yards (27.43 meters to 45.728 meters) long (depending on fabric weight).

Generally, sliver knitting is a knitting process which locks individual pile fibers directly into a lightweight knit backing or base material in a manner wherein the pile fibers extend from one side of the knit base material. The knit base material itself is made from yarn, which may be knitted in a single jersey circular knitting process on a circular knitting machine, with closely packed U-shaped tufts of the fibers being knitted into the knit base material which anchors them in the completed pile fabric. The free ends of the fibers extend from one side of the knit base material to provide a deep pile face. The knit base material is typically made of synthetic yarns, with the pile being made of a desired natural or synthetic fiber, or a blend of different fibers.

Such fabrics are illustrated, for example, in U.S. Pat. No. 1,791,741, to Moore, U.S. Pat. No. 2,737,702, to Schmidt et al., U.S. Pat. No. 3,226,952, to Cassady, U.S. Pat. No. 3,853,680, to Daniel, U.S. Pat. No. 3,894,409, to Clingan et al., U.S. Pat. No. 4,236,286, to Abler et al., U.S. Pat. No. 4,513,042, to Lumb, and U.S. Pat. No. 6,766,668, to Sinykin, all of which patents are hereby incorporated herein by reference. Such sliver knit high pile fabrics are manufactured on circular sliver knitting machines and have been widely used for many years in the manufacture of paint roller covers. The circular sliver knitting machines produce large diameter tubular knitted pile fabric segments having the pile located on the inside.

The large diameter tubular knitted pile segments are slit longitudinally to produce wide, extended knitted pile segments of fabric which are tensioned longitudinally and transversely, stretched, and back coated on the non-pile side with a stabilized coating composition which is typically heated to stabilize the coated, wide, extended knitted pile segment. The coated, wide, extended knitted pile segment can then be subjected to a shearing operation to achieve a uniform pile length. The sheared, coated, wide, extended knitted pile segment is then slit into a plurality of two and seven-eighths inch (73 millimeter) wide knitted pile fabric strips, which are rolled onto a core to produce twenty rolls of knitted pile fabric strips.

Paint roller covers are manufactured by using a hollow cylindrical core made of cardboard or thermoplastic material which has the knitted pile fabric strip helically wound around the core. During the manufacture of paint roller covers, the knitted pile fabric strips are secured to the core either by using adhesive or epoxy, or by thermally bonding the knitted pile fabric strip in place on a thermoplastic core. For examples of these manufacturing processes see U.S. Pat. No. 4,692,975, to Garcia (the "'975 Patent"), U.S. Pat. No. 5,572,790, to Sekar (the "'790 Patent"), and U.S. Pat. No. 6,159,320, to Tams et al. (the "'320 Patent"), each of which are hereby incorporated by reference.

U.S. Pat. No. 7,503,191, to Knight et al., which is hereby incorporated by reference herein in its entirety, discloses a novel fabric for use in a paint roller cover in which a small diameter tubular sliver knitted pile fabric is manufactured with the sliver pile side facing outwardly rather than inwardly and with a diameter suitable for mounting on a paint roller cover core in a seamless manner. The above-incorporated by reference U.S. patent application Ser. No. 12/116,022 discloses another novel fabric for use in a paint roller cover in which a small diameter tubular knitted pile fabric which is manufactured with a cut pile yarn side facing outwardly also with a diameter suitable for mounting on a paint roller cover core in a seamless manner. U.S. Pat. No. 7,596,972, to Knight, Sr. et al., which is hereby incorporated by reference herein in its entirety, discloses still another novel fabric for use in a paint roller cover in which a small diameter tubular knitted pile fabric which is manufactured with a hybrid sliver/cut pile side facing outwardly rather than inwardly and with a diameter suitable for mounting on a paint roller cover core in a seamless manner. The machines to manufacture these tubular knitted pile fabrics are disclosed in U.S. Pat. No. 7,503,190, to Knight, Sr. et al., which is hereby incorporated by reference herein in its entirety, the above-incorporated by reference U.S. patent application Ser. No. 12/643,724, and U.S. Pat. No. 7,552,602, to Knight, Sr. et al., which is hereby incorporated by reference herein in its entirety.

The above-incorporated by reference U.S. patent application Ser. Nos. 12/100,050, 12/132,774, 12/257,039, 12/258,036, and 12/257,815 disclose various methods of manufacturing a paint roller cover from any of the small diameter tubular sliver knitted pile fabrics referenced above. These methods of manufacture include the use of a core which may be made of a segment of dry adhesive film or tape wound on a non-stick mandrel, following which the tubular knitted pile fabric segment is placed over the dry adhesive film. The mandrel is then heated to cause the dry adhesive film to fuse with the backing or base of the tubular knitted pile fabric to create a semi-rigid paint roller cover.

Alternatively, low melt yarns and/or fibers may be used for the base and/or the pile of a tubular knitted pile fabric, as discussed in U.S. Pat. No. 6,766,668, to Sinykin, which patent is assigned to the assignee of the present invention, and which patent is hereby incorporated herein by reference in its entirety. The tubular knitted pile fabric is then placed onto a cylindrical mandrel optionally having a non-stick coating and heated with a heating mechanism contained in the mandrel to a desired temperature to activate the low melt yarn. The melted lower melting point component of the low melt yarn used in the base and/or the pile of the tubular knitted pile fabric flows into the cylindrical form of the outside of the cylindrical mandrel, and locks the pile fibers or cut pile yarn segments into the tubular knitted pile fabric.

Also alternatively, a tubular knitted pile fabric having low melt yarns and/or fibers may be used in conjunction with dry adhesive film or tape to form a semi-rigid core. As still another alternative, and either with or without utilizing the dry adhesive film or tape, at least one layer of spray adhesive may be applied onto an integral core formed by heating and then cooling the low melt yarns and/or fibers of a tubular knitted pile fabric to create an enhanced semi-rigid cylindrical assembly having a pile surface.

While these methods have been advantageously used to provide a variety of semi-rigid paint roller covers, such paint roller covers have one thing in common with their helically wound predecessors: namely, they have been contemplated as being shipped, displayed, and sold in conventional packaging. Upon reflection, it is apparent that the very configuration of a paint roller cover is a space inefficient design, since by their very nature paint roller covers are hollow and have a fixed outer dimension equal to their outer diameter, typically between one and three-quarters inches (44.45 millimeters) and three inches (76.2 millimeters), and a typical length of between three inches (76.2 millimeters) and twelve inches (304.8 millimeters).

The most common paint roller cover size is approximately two inches (50.8 millimeters) in outer diameter and nine inches (228.6 millimeters) in length plus packaging (which can be significant if it is a hard plastic package). This translates to a paint roller cover shipping and shelf space area of not less than 36 cubic inches (589.93 cubic centimeters), irrespective of packaging. Conventional paint roller covers are typically shipped in plastic bags, so their packaging does not add significantly to their volume.

It will be appreciated that with both shipping volume and shelf space at a premium, the large shipping and shelf space volume required by conventional paint roller covers represents a significant cost that must be reflected in both the transfer price and the final selling price of the paint roller covers. Given the fact that most paint roller covers (particularly lower end models) are commodities that are mass-manufactured and sell for relatively low prices, it will be appreciated that the large shipping and shelf space volume required by conventional paint roller covers presents a significant financial burden.

It will thus be appreciated that it is highly desirable to significantly reduce both shipping and display shelf space volumes required by paint roller covers and the packaging used for the paint roller covers. It will also be appreciated that whatever solution is proposed to allow the packaging of paint roller covers in a lower volume must not have an adverse effect on the quality of the paint roller covers. In addition, the changes to the paint roller covers and/or the packaging for the paint roller covers must not substantially increase the manufacturing or packaging complexity of the paint roller covers.

The compactly packaged paint roller cover of the present invention must also be of construction which is both durable and long lasting, and the packaged paint roller covers should require no special handling to be provided during shipping, display, or storage prior to the paint roller covers being used. In order to enhance the market appeal of the compactly packaged paint roller cover of the present invention, it should also be of inexpensive construction to thereby afford it the broadest possible market. Finally, it is also an objective that all of the aforesaid advantages and objectives be achieved by the compactly packaged paint roller cover of the present invention without incurring any substantial relative disadvantage.

SUMMARY OF THE INVENTION

The disadvantages and limitations of the background art discussed above are overcome by the present invention. With this invention, a semi-rigid paint roller cover that may be manufactured according to any one or a combination of the techniques described above is placed within a vacuum sealable plastic bag, which is subsequently evacuated and sealed. Such vacuum sealable plastic bags and materials for making the same are widely known, and are disclosed, for example, in U.S. Pat. No. Re. 34,929, to Kristen, which patent is hereby incorporated herein by reference. Typically, vacuum sealable plastic bags contain two opposing surfaces and are sealed together on three sides and open on a fourth side. One of the opposing surfaces incorporates small interconnected air channels to facilitate the removal of air in the vacuum sealable plastic bag. Once the contents have been placed inside the vacuum sealable plastic bag and the air within the vacuum sealable plastic bag has been withdrawn, a heat seal is made between the two opposing surfaces near the fourth side of the vacuum sealable plastic bag to retain the vacuum within the vacuum sealable plastic bag.

Vacuum sealable plastic bags present two primary advantages in packaging their contents. First, they ensure that the vacuum sealable plastic bag and its contents occupy the minimum volume possible, since essentially all of the air has been withdrawn from the vacuum sealable plastic bag. In doing so, if the contents of the vacuum sealable plastic bag are at all compressible, they will be compressed to a minimal volume. This is only practical assuming that the contents of the vacuum sealable plastic bag are both compressible and resilient. Thus, items such as towels and clothing, which are both compressible and resilient, may be advantageously stored in vacuum sealable plastic bags to reduce their volume, while compressible but not resilient items such as bread, which is compressible but not resilient, may not. A wide variety of different vacuum sealable bags are known, and virtually any of them could potentially be used with the present invention, although vacuum sealable bags that are clear on at least one side are preferred.

Multiple configurations of vacuum sealing equipment for use in vacuum sealing vacuum sealable plastic bags are also widely known, and are disclosed, for example, in U.S. Pat. No. 4,221,101, to Woods. External vacuum sealers have vacuum sealable plastic bags attached to the vacuum sealing machine externally, with the vacuum sealing machine removing air from the vacuum sealable plastic bags which are then heat sealed to retain the vacuum within. Chamber vacuum sealers place vacuum sealable plastic bags and their contents within a chamber of the vacuum sealing machine, with the chamber being evacuated and the vacuum sealable plastic bags subsequently being heat sealed. The chamber of the vacuum sealing machine may then be opened and the sealed vacuum sealable plastic bags and their contents may be removed. Either type of vacuum sealer could potentially be used with the present invention.

The vacuum sealable plastic bags are sized for a paint roller cover, of which, for example, the most common size is approximately two inches (50.8 millimeters) in outer diameter and nine inches (228.6 millimeters) in length. In order to accommodate a semi-rigid paint roller cover of this size, a vacuum sealable plastic bag would need to be at least approximately four inches (101.6 millimeters) wide and at least approximately eleven inches (279.4 millimeters) long. The vacuum sealable plastic bags are sealed on three sides thereof and have a single open end.

The compactly packaged paint roller cover of the present invention may incorporate any semi-rigid paint roller cover that can collapse to a flattened configuration. Such semi-rigid paint roller covers may be fabricated from the tubular knitted pile fabric disclosed in any of above-incorporated by references U.S. Pat. No. 7,503,191 (small diameter tubular sliver knitted pile fabric), U.S. patent application Ser. No. 12/116,022 (small diameter tubular knitted cut pile fabric), or U.S. Pat. No. 7,596,972 (hybrid small diameter tubular knitted sliver/cut pile fabric). Alternatively, any other suitable materials may instead be used. These small diameter tubular knitted pile fabrics may be manufactured using the machines and technology disclosed in the above-incorporated by reference U.S. Pat. No. 7,503,190, U.S. patent application Ser. No. 12/643,724, or U.S. Pat. No. 7,552,602. Alternatively, any other suitable machines and technology may instead be used.

The semi-rigid paint roller cover may be fabricated from any of these small diameter tubular knitted pile fabrics according to any of the technologies disclosed in any of above-incorporated by reference U.S. patent application Ser. Nos. 12/100,050, 12/132,774, 12/257,039, 12/258,036, and 12/257,815, all of which may be used with any of the tubular knitted pile fabrics referenced above. However, it should be understood that any other suitable semi-rigid paint roller cover may instead be used.

These semi-rigid paint roller cover manufacturing technologies include (but are not limited to): a. the use of a core which may be made of a segment of dry adhesive film or tape wound on a non-stick mandrel, following which the tubular knitted pile fabric segment is placed over the dry adhesive film and the mandrel is then heated to cause the dry adhesive film to fuse with the backing or base of the tubular knitted pile fabric; b. using low melt yarns and/or fibers (as discussed in above-incorporated by reference U.S. Pat. No. 6,766,668) for the base and/or the pile of a tubular knitted pile fabric, with the tubular knitted pile fabric then being placed onto a mandrel and heated to activate the low melt yarn to lock the pile fibers or cut pile yarn segments into the tubular knitted pile fabric; c. using a tubular knitted pile fabric having low melt yarns and/or fibers in conjunction with dry adhesive film or tape to form a semi-rigid core; d. either with or without utilizing a dry adhesive film or tape, applying one or more layers of spray adhesive onto an integral core formed by heating low melt yarns and/or fibers of a tubular knitted pile fabric to create an enhanced semi-rigid cylindrical assembly having a pile surface; and e. various combinations thereof.

The semi-rigid paint roller cover is inserted completely into the vacuum sealable plastic bag through the open end thereof. The vacuum sealable plastic bag with the semi-rigid paint roller cover therein then has its open end placed into communication with a vacuum sealing apparatus that will vacuum the air out of the vacuum sealable plastic bag, which will cause the semi-rigid paint roller cover therein to collapse to a flattened configuration. When substantially all of the air within the vacuum sealable plastic bag has been withdrawn, the open end of the vacuum sealable plastic bag is sealed. The volume of the compactly packaged paint roller cover of the present invention required to ship and display it is substantially smaller than the volume required to ship and display a conventional paint roller cover, typically being on the order of as little as ten percent of the volume required to ship and display a conventional paint roller cover.

Since the compactly packaged paint roller cover of the present invention requires substantially less volume to ship and display than a conventional paint roller cover, it will be appreciated that it presents significant cost savings due to the increased shipping efficiency as well as being advantageous in the eyes of retailers due to the reduced shelf space required to display it. Following purchase, a user opens the vacuum sealed plastic bag and the semi-rigid paint roller cover therein tends to resiliently resume its round cross-section.

It may therefore be seen that the present invention teaches a compactly packaged paint roller cover that requires significantly reduced shipping and display shelf space volumes. The compactly packaged paint roller cover of the present invention allows the packaging of paint roller covers in a lower volume without having an adverse effect on the quality of the paint roller covers. In addition, the compactly packaged paint roller cover of the present invention does not substantially increase the manufacturing or packaging complexity required to manufacture and package them.

The compactly packaged paint roller cover of the present invention is of a construction which is both durable and long lasting, and the packaged paint roller covers require no special handling to be provided during shipping, display, or storage prior to the paint roller covers being used. The compactly packaged paint roller cover of the present invention is inexpensive to manufacture and package to enhance its market appeal and to thereby afford it the broadest possible market. Finally, all of the aforesaid advantages and objectives of the compactly packaged paint roller cover of the present invention are achieved without incurring any substantial relative disadvantage.

DESCRIPTION OF THE DRAWINGS

These and other advantages of the present invention are best understood with reference to the drawings, in which:

FIG. 9 is an isometric view showing a plurality of the sealed and evacuated vacuum sealable bags each containing a semi-rigid paint roller cover disposed adjacent a single conventional paint roller cover for a comparison of their relative sizes;

FIG. 10 is an isometric view showing a first alternate embodiment sealed and evacuated vacuum sealable bags containing a semi-rigid paint roller cover, with notches being located in the sides of the vacuum sealable plastic bag to facilitate opening the vacuum sealable plastic bag;

DETAILED DESCRIPTION OF THE EXEMPLARY EMBODIMENTS

Figure 1:
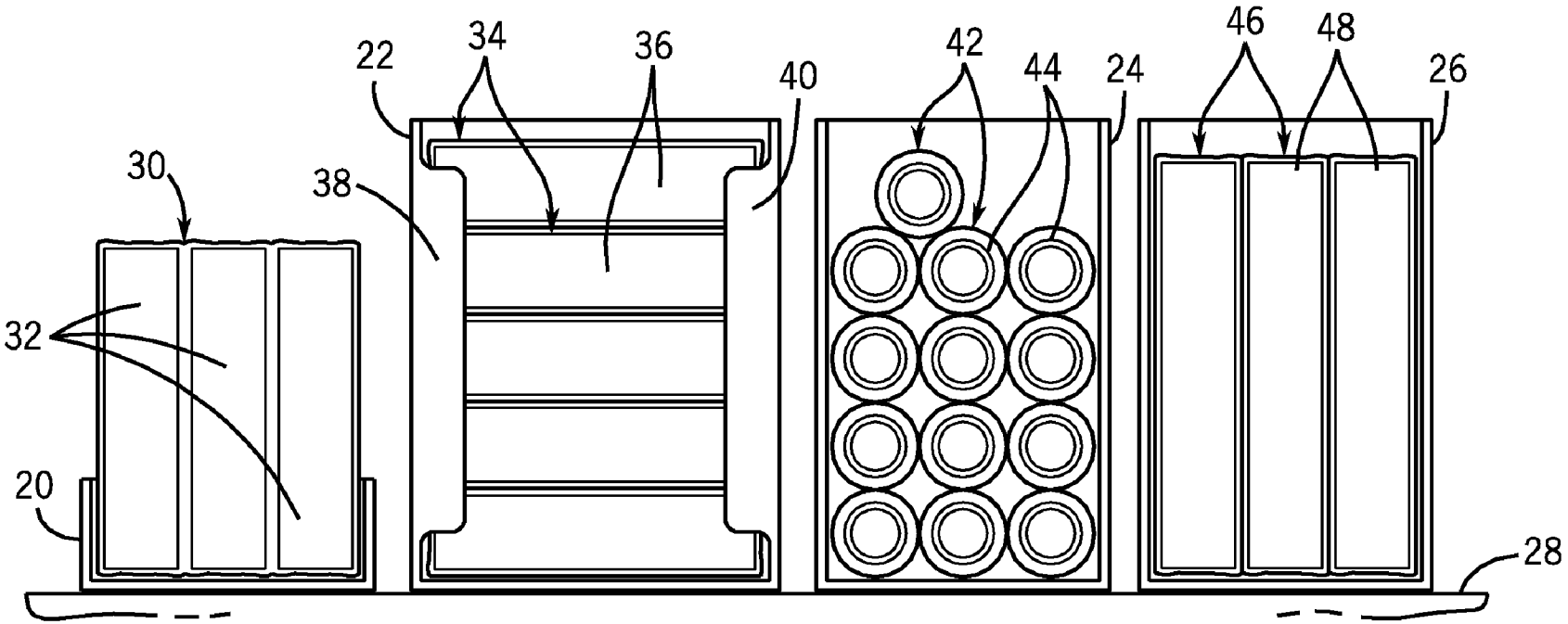
FIG. 1 PRIOR ART
FIG. 1 is an isometric view of a plurality of paint rollers in conventional packaging on a display shelf.

Referring initially to FIG. 1, a plurality of conventional paint roller covers are shown in four display cartons 20, 22, 24, and 26, all of which are located on a display shelf 28. The display carton 20 contains a plurality of three-packs 30 of paint roller covers 32, which are oriented vertically in the display carton 20. The display carton 22 contains a plurality of horizontally oriented single packages 34 each containing a single paint roller cover 36 that are oriented parallel to the open front-facing side of the display carton 22. It may be seen that the display carton 22 has a pair of flaps 38 and 40 extending into its otherwise open front-facing side to retain the single packages 34 each containing a single paint roller cover 36 therein.

The display carton 24 contains a plurality of horizontally oriented single packages 42 each containing a single paint roller cover 44 that are oriented orthogonally to the open front-facing side of the display carton 24. Finally, the display carton 26 contains a plurality of vertically oriented single packages 46 each containing a single paint roller cover 48. These display cartons 20, 22, 24, and 26 are typical of containers used to ship and display paint roller covers. It will be appreciated that the bulk of the volume of such shipping containers is empty space, and that such shipping containers do not represent an efficient way to either ship or display paint roller covers.

Figure 2:
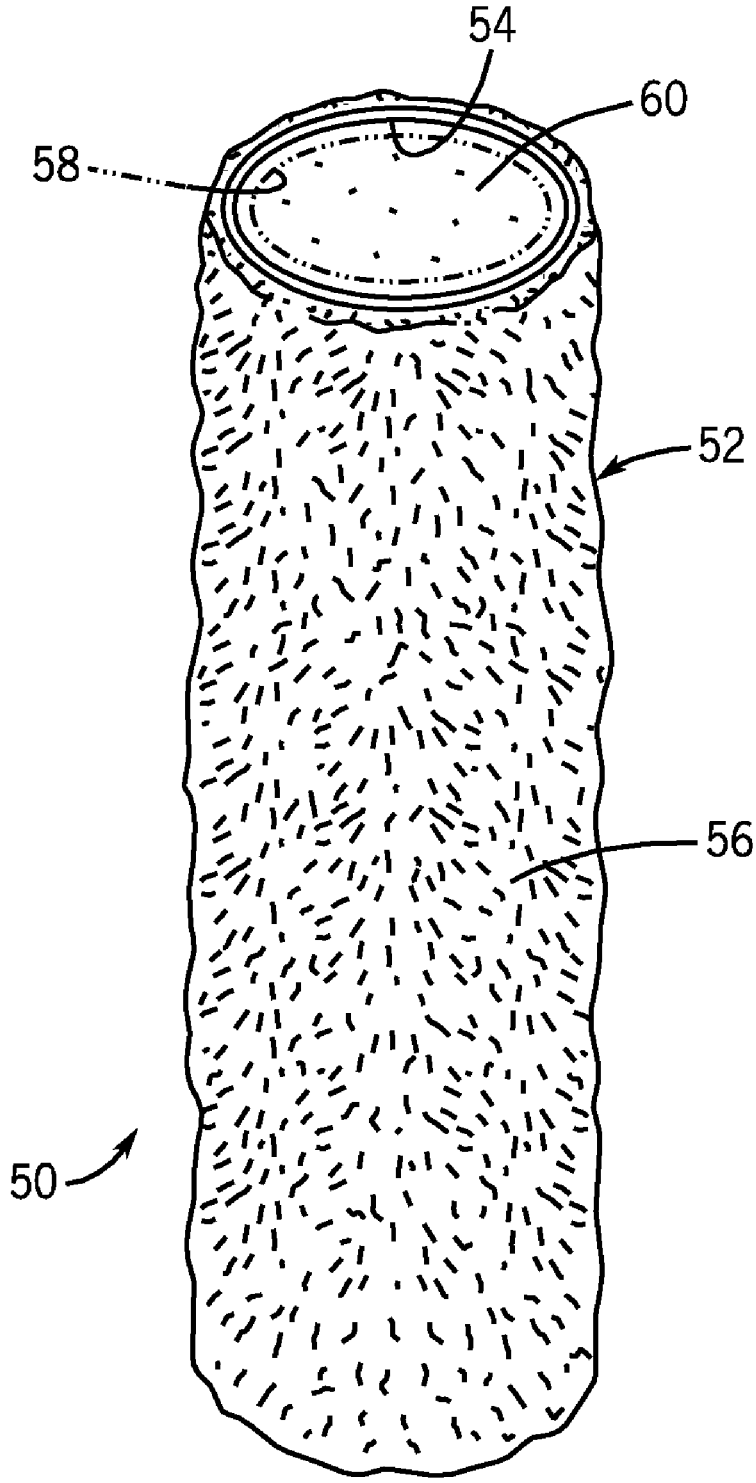
FIG. 2 is an isometric view of an exemplary semi-rigid paint roller cover which may be made using any of a number of different methods.

An exemplary embodiment of a semi-rigid paint roller cover 50 representative of the technology disclosed above (fabricated from the tubular knitted pile fabric disclosed in any of the above-incorporated by references U.S. Pat. No. 7,503,191, U.S. Patent application Ser. No. 12/116,022, or U.S. Pat. No. 7,596,972; using the machines and technology disclosed in the above-incorporated by reference U.S. Pat. No. 7,503,190, U.S. patent application Ser. No. 12/643,724, or U.S. Pat. No. 7,552,602; using any of these small diameter tubular knitted pile fabrics according to any of the technologies disclosed in any of above-incorporated by reference U.S. patent application Ser. Nos. 12/100,050, 12/132,774, 12/257,039, 12/258,036, and 12/257,815) is shown in FIG. 2.

The semi-rigid paint roller cover 50 is based upon a tubular cut pile knit segment 52 that may be a sliver knit fabric, a cut pile knit fabric, or a hybrid sliver/cut pile knit fabric. The tubular cut pile knit segment 52 consists of a knit base material 54 having pile fibers 56 extending from the knit base material 54 on the outer surface of the tubular cut pile knit segment 52. Optionally, low melt yarns and/or fibers may be used for either or both of the knit base material 54 and the pile fibers 56 of the tubular cut pile knit segment 52 with heating being used to activate the low melt yarns and/or fibers to lock the pile fibers 56 into the knit base material 54.

Also, optionally, a dry adhesive film core 58 may be utilized as a core in the tubular cut pile knit segment 52 by heating the dry adhesive film core 58 to secure the tubular cut pile knit segment 52 to the dry adhesive film core 58. Finally, optionally one or more layers of spray adhesive 60 may be applied to the interior of the semi-rigid paint roller cover 50 to enhance its rigidity. It will be appreciated that the semi-rigid paint roller cover 50 may be manufactured using any one or combination of these optional manufacturing techniques, as provided in the above-incorporated by reference U.S. patents and patent applications. The important thing to note about the semi-rigid paint roller cover 50 is that it has a semi-rigid configuration, and, as such, it can be deformed to the point of flattening it, and subsequently it will be able to resume the cylindrical configuration shown in FIG. 2 as well as in subsequent figures, as will become apparent from the following narrative.

Figure 3:
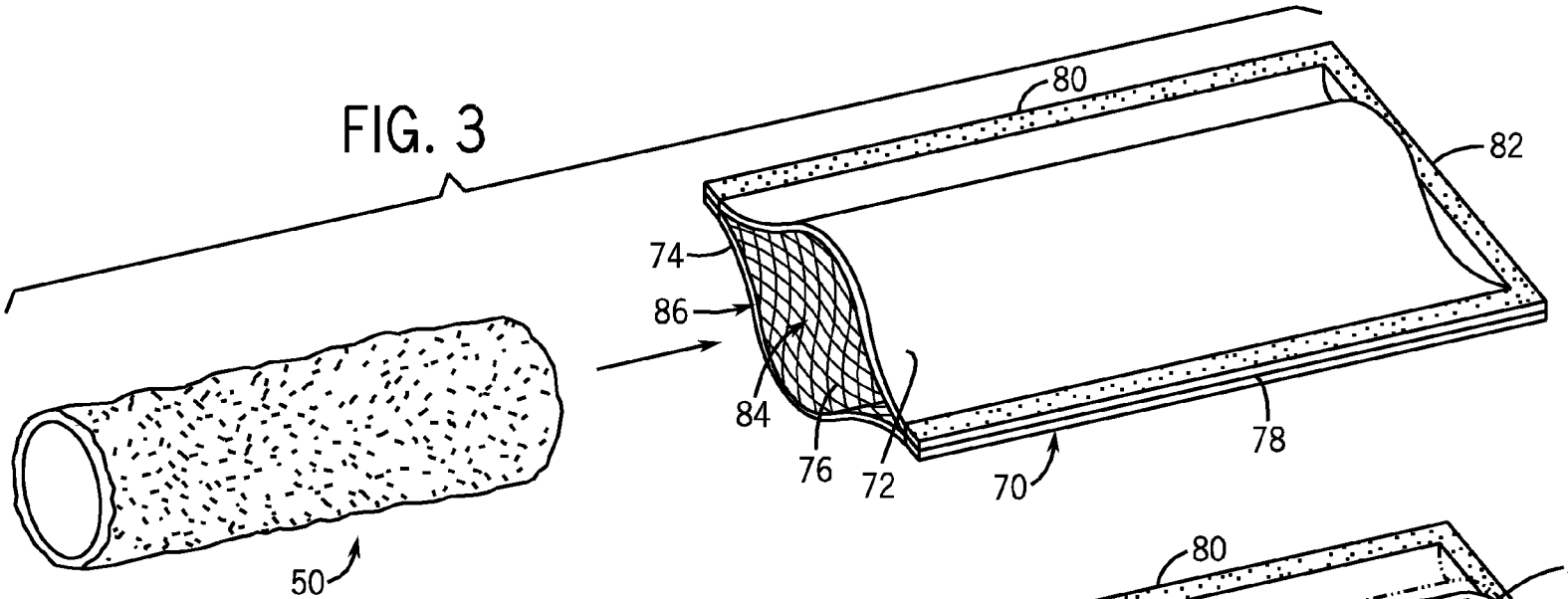
FIG. 3 is an exploded isometric view of the semi-rigid paint roller cover illustrated in FIG. 2 being inserted into a vacuum sealable bag.

Referring next to FIG. 3, a vacuum sealable plastic bag 70 is illustrated that is sized to accommodate the semi-rigid paint roller cover 50 therein with sufficient space to allow the vacuum sealable plastic bag 70 to be vacuum sealed. For example, for a semi-rigid paint roller cover 50 of the most common size (approximately two inches (50.8 millimeters) in outer diameter and nine inches (228.6 millimeters) in length), the vacuum sealable plastic bag 70 could be rectangular in configuration and approximately four inches (101.6 millimeters) wide and at least approximately eleven inches (279.4 millimeters) long.

The vacuum sealable plastic bag 70 shown in FIG. 3 includes a flat side wall 72 and an opposed textured side wall 74 that has a network of shallow interconnected air channels 76 located on the inside (the side facing the flat side wall 72 of the vacuum sealable plastic bag 70). The flat side wall 72 and the textured side wall 74 of the vacuum sealable plastic bag 70 are sealed on opposite longitudinal sides 78 and 80 thereof and on one end 82 thereof. The vacuum sealable plastic bag 70 has an opening 84 located in an open end 86 of the vacuum sealable plastic bag 70.

The flat side wall 72 and the textured side wall 74 of the vacuum sealable plastic bag 70 may be of single layer or multi-layer construction, and must of course be gas impermeable. The vacuum sealable plastic bag 70 must also use heat-sealable thermoplastic materials so that the flat side wall 72 and the textured side wall 74 of the vacuum sealable plastic bag 70 can be heat sealed together to close the vacuum sealable plastic bag 70 once the air has been removed from the interior of the vacuum sealable plastic bag 70. The construction of such vacuum sealable plastic bags is well known in the art, as exemplified by the above-incorporated by reference U.S. Pat. No. Re. 34,929.

Suitable heat sealable thermoplastics include polyethylene, polypropylene, and polystyrene, which are not gas impermeable materials. If such materials are to be used as the inner layers of the flat side wall 72 and the textured side wall 74 of the vacuum sealable plastic bag 70, an outer layer of a gas impermeable material such as polyester or polyamide (nylon) may be used. If desired, an intermediate layer of a material such as high density polyethylene may be used. The layers may be laminated, coextruded, or extrusion-coated to form the flat side wall 72 and the textured side wall 74 of the vacuum sealable plastic bag 70. Typically the thickness of each of the flat side wall 72 and the textured side wall 74 will be between approximately two mils and five mils. Other materials and thicknesses that are suitable may instead be used if desired.

As indicated by the arrow in FIG. 3, the semi-rigid paint roller cover 50 is inserted through the opening 84 in the open end 86 of the vacuum sealable plastic bag 70 fully into the vacuum sealable plastic bag 70. When the semi-rigid paint roller cover 50 is so located within the vacuum sealable plastic bag 70, the open end 86 of the vacuum sealable plastic bag 70 may be closed so that the portions of the flat side wall 72 and the textured side wall 74 of the vacuum sealable plastic bag 70 located near the open end 86 of the vacuum sealable plastic bag 70 are pressed together prior to the vacuum sealable plastic bag 70 being vacuum sealed.

Figure 4:
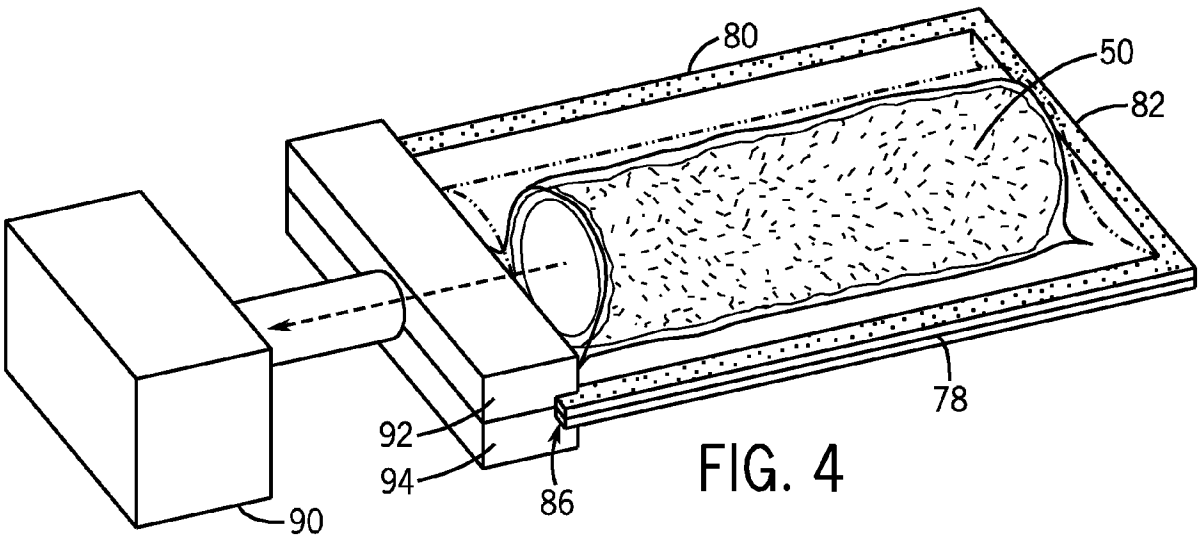
FIG. 4 is an isometric view of the vacuum sealable bag containing the semi-rigid paint roller cover illustrated in FIG. 3 having the air contained therein being removed by a vacuum pump.

Referring now to FIG. 4, an external sealing apparatus 90 is shown which has an opposed pair of sealing jaws 92 and 94 that are engaging the open end 86 of the vacuum sealable plastic bag 70 therebetween. The construction and operation of both the external sealing apparatus 90 and the sealing jaws 92 and 94 are of conventional design in the art. Once the sealing jaws 92 and 94 are engaging the open end 86 of the vacuum sealable plastic bag 70, the air inside the vacuum sealable plastic bag 70 may be evacuated, as schematically indicated by the phantom arrow in FIG. 4. This will cause the vacuum sealable plastic bag 70 to collapse into a flattened configuration, which will also flatten the semi-rigid paint roller cover 50 inside the vacuum sealable plastic bag 70.

Figure 5:
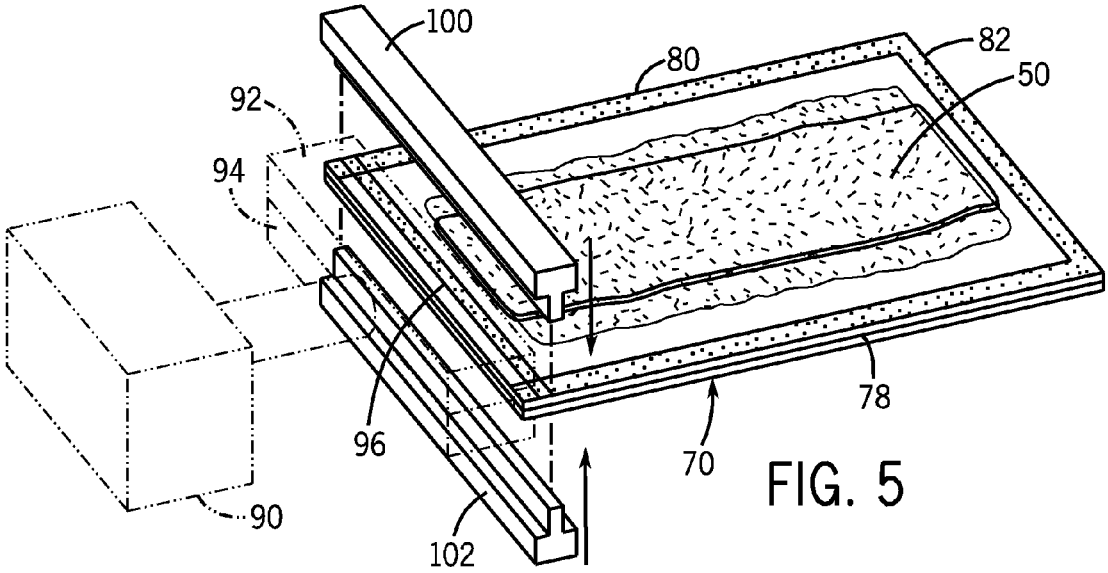
FIG. 5 is an isometric view of the now-evacuated vacuum sealable bag containing the semi-rigid paint roller cover illustrated in FIG. 4 being sealed.

Referring next to FIG. 5, the vacuum sealable plastic bag 70 and the semi-rigid paint roller cover 50 are shown collapsed into flattened configurations inside the evacuated vacuum sealable plastic bag 70. With the external sealing apparatus 90 and the sealing jaws 92 and 94 are still connected to the now-closed open end 86 of the evacuated vacuum sealable plastic bag 70, a pair of opposed heat sealing members 100 and 102 which are disposed above and below the evacuated vacuum sealable plastic bag 70 near the now-closed open end 86 of the evacuated vacuum sealable plastic bag 70 are brought into engagement with the evacuated vacuum sealable plastic bag 70 as shown by the arrows in FIG. 5 to produce a heat seal 96 which seals the evacuated vacuum sealable plastic bag 70 containing the flattened semi-rigid paint roller cover 50 closed. The construction and operation of the sealing jaws 92 and 94 are of conventional design in the art.

Figure 6:
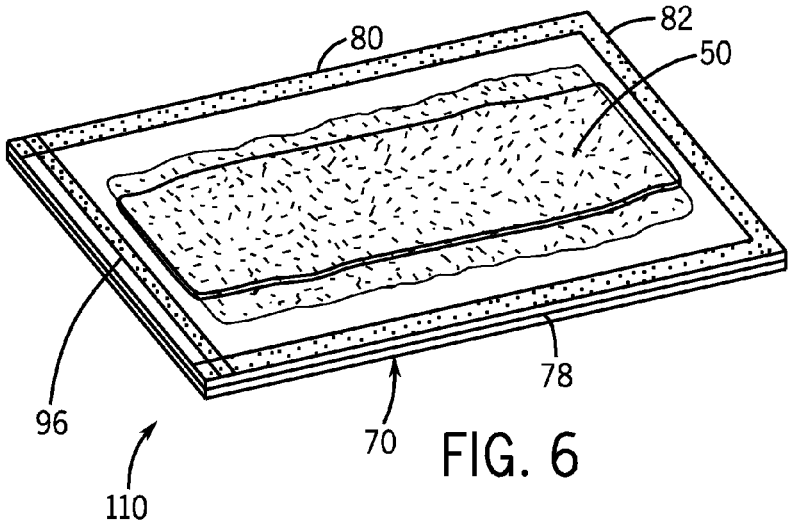
FIG. 6 is an isometric view of the now-sealed and evacuated vacuum sealable bag containing the semi-rigid paint roller cover illustrated in FIG. 5.
Figure 7:
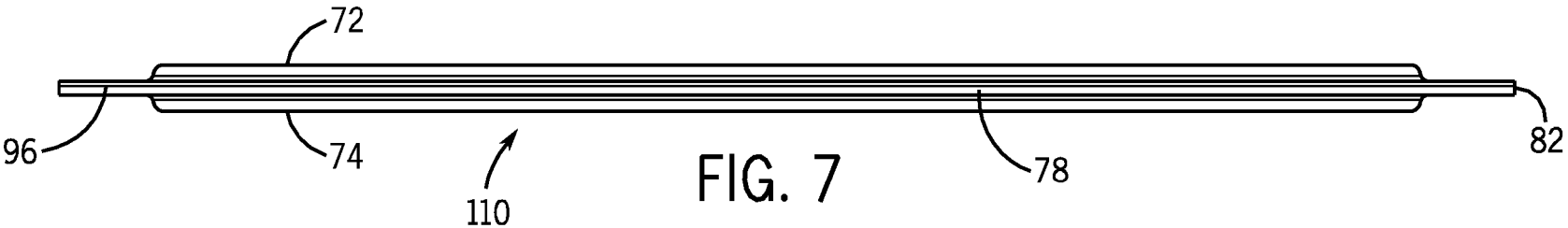
FIG. 7 is a lateral side view of the sealed and evacuated vacuum sealable bag containing the semi-rigid paint roller cover illustrated in FIG. 6.
Figure 8:
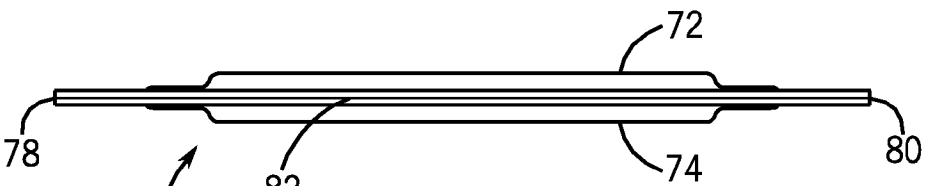
FIG. 8 is an end view of the sealed and evacuated vacuum sealable bag containing the semi-rigid paint roller cover illustrated in FIGS. 6 and 7.

The sealing jaws 92 and 94 may then be retracted and the external sealing apparatus 90 and the sealing jaws 92 and 94 may be removed as well, leaving a compactly packaged paint roller cover 110 which consists of the now-sealed, evacuated vacuum sealable plastic bag 70 containing the flattened semi-rigid paint roller cover 50 as shown in FIGS. 6, 7, and 8. The compactly packaged paint roller cover 110 of the present invention thus has a footprint of approximately four inches (101.6 millimeters) wide, at least approximately eleven inches (279.4 millimeters) long, and approximately one-eighth of an inch (3.18 millimeters) thick.

Referring finally to FIG. 9, a conventional paint roller cover 120 is shown adjacent to a stack of ten of the compactly packaged paint roller covers 110 for purposes of a size comparison. It may be seen that the stack of ten compactly packaged paint roller covers 110 is less than the height of the conventional paint roller cover 120, even though the semi-rigid paint roller cover 50 contained in the compactly packaged paint roller cover 110 is the same size as the conventional paint roller cover 120. The tremendous reduction in volume of the compactly packaged paint roller cover 110 as compared to the conventional paint roller cover 120 will thus be readily apparent to those skilled in the art.

Several alternate embodiments may also be utilized with the compactly packaged paint roller cover of the present invention to facilitate opening the vacuum sealable plastic bag 70 to remove the compactly packaged paint roller cover 110 may be included in design of the vacuum sealable plastic bag 70. For example, as shown in a first alternate embodiment compactly packaged paint roller cover 130 illustrated in FIG. 10, notches 132 and 134 could be placed in the longitudinal sides 78 and/or 80 of the vacuum sealable plastic bag 70 on the side of the heat seal 96 closest to the sealed end 82 of the vacuum sealable plastic bag 70 to facilitate opening the vacuum sealable plastic bag 70.

Figure 11:
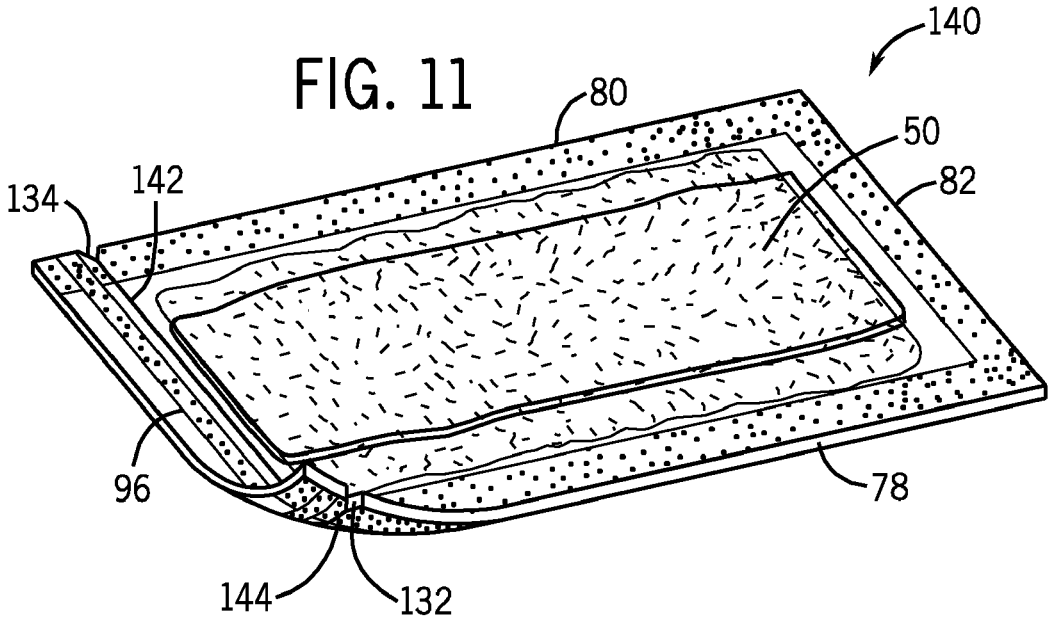
FIG. 11 is an isometric view showing a second alternate embodiment sealed and evacuated vacuum sealable bags containing a semi-rigid paint roller cover, with notches being located in the sides of the vacuum sealable plastic bag and scoring located on the outside surfaces of the vacuum sealable plastic bag extending between the notches to facilitate opening the vacuum sealable plastic bag.
Figure 12:
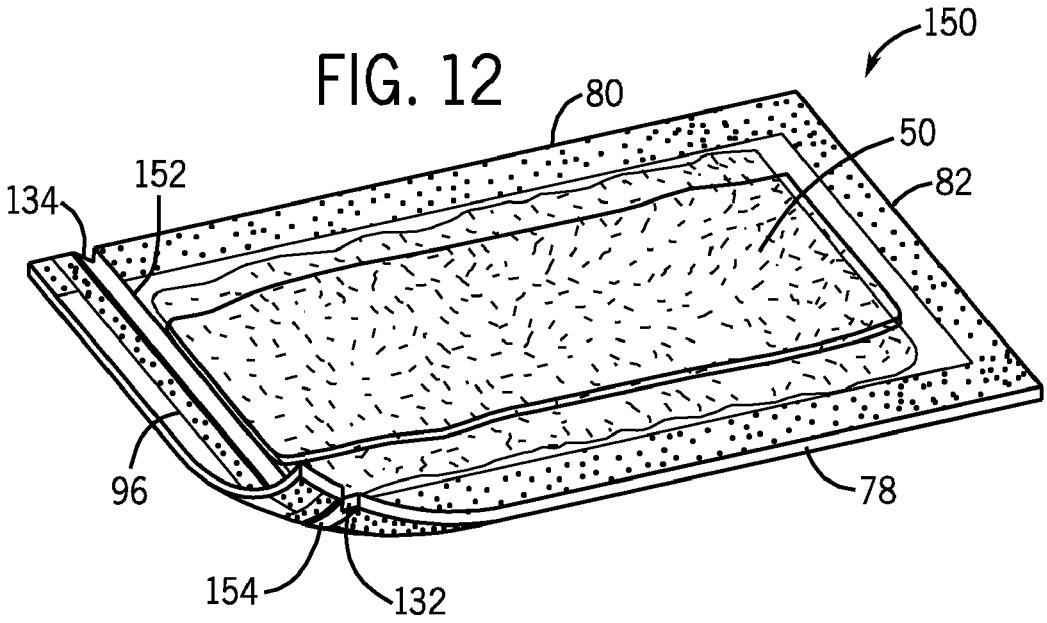
FIG. 12 is an isometric view showing a third alternate embodiment sealed and evacuated vacuum sealable bags containing a semi-rigid paint roller cover, with notches being located in the sides of the vacuum sealable plastic bag and tear tapes located in the side walls of the vacuum sealable plastic bag extending between the notches to facilitate opening the vacuum sealable plastic bag.

A second alternate embodiment compactly packaged paint roller cover 140 illustrated in FIG. 11 also including the notches 132 and 134 has score lines 142 and 144 respectively located in the outer surfaces of the side walls 72 and 74 of the vacuum sealable plastic bag 70 intermediate the notches 132 and 134 and on the side of the heat seal 96 closest to the sealed end 82 of the vacuum sealable plastic bag 70 to further facilitate tearing the end off of the vacuum sealable plastic bag 70. Alternately only a single one of the score lines 142 and 144 may be used instead, and also alternately the notches 132 and 134 may be omitted. As shown in a third alternate embodiment compactly packaged paint roller cover 150 illustrated in FIG. 12 in addition to the notches 132 and 134, instead of score lines, tear tapes 152 and 154 may be respectively embedded in the side walls 72 and 74 of the vacuum sealable plastic bag 70 adjacent the side of the heat seal 96 nearest the sealed end 82 of the vacuum sealable plastic bag 70 to facilitate tearing the end off of the vacuum sealable plastic bag 70. Alternately only a single one of the tear tapes 152 and 154 may be used instead, and also alternately the notches 132 and 134 may be omitted. Finally, other combinations of such opening mechanisms could also be used.

It may therefore be appreciated from the above detailed description of the exemplary embodiments of the present invention that it teaches a compactly packaged paint roller cover that requires significantly reduced shipping and display shelf space volumes. The compactly packaged paint roller cover of the present invention allows the packaging of paint roller covers in a lower volume without having an adverse effect on the quality of the paint roller covers. In addition, the compactly packaged paint roller cover of the present invention does not substantially increase the manufacturing or packaging complexity required to manufacture and package them.

The compactly packaged paint roller cover of the present invention is of a construction which is both durable and long lasting, and the packaged paint roller covers require no special handling to be provided during shipping, display, or storage prior to the paint roller covers being used. The compactly packaged paint roller cover of the present invention is inexpensive to manufacture and package to enhance its market appeal and to thereby afford it the broadest possible market. Finally, all of the aforesaid advantages and objectives of the compactly packaged paint roller cover of the present invention are achieved without incurring any substantial relative disadvantage.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A sealed paint roller cover package, comprising:

a paint roller cover comprising:

a tubular knitted pile fabric sleeve comprising a pile formed of pile strands knitted into and extending outwardly from a base fabric having a tubular configuration defining an outside and an inside; and a semi-rigid cylindrical core member formed inside said tubular knitted pile fabric sleeve, which core member incorporates said base fabric therein and retains said pile strands thereto; wherein said paint roller cover is semi-rigid such that it may be substantially flattened and subsequently resume a cylindrical configuration; and a flexible, gas-impermeable plastic storage bag of a size sufficient to receive said paint roller cover entirely therein;

wherein said plastic storage bag may be evacuated and sealed with said paint roller cover contained therein to cause said paint roller cover to be flattened such that said sealed paint roller cover package is substantially thinner than the diameter of said paint roller cover.

2. A sealed paint roller cover package as defined in claim 1, wherein said base fabric has a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric; and wherein said pile strands comprise a plurality of tufts of fibers, each of said tufts of fibers having opposite ends with a loop portion located therebetween, said loop portion of each of said plurality of tufts being knitted together with a loop of said base fabric into said base fabric, said opposite ends of said plurality of tufts of fibers extending outwardly from said base fabric and forming the pile of said tubular knitted pile fabric sleeve.

3. A sealed paint roller cover package as defined in claim 1, wherein said base fabric has a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric; and wherein said pile strands comprise a plurality of cut pile segments, each of said cut pile segments having opposite ends with a loop portion located therebetween, said loop portion of each of said plurality of cut pile segments being knitted together with a loop of said base fabric into said base fabric, said opposite ends of said plurality of cut pile segments extending outwardly from said base fabric and forming the pile of said tubular knitted pile fabric sleeve.

4. A sealed paint roller cover package as defined in claim 1, wherein said base fabric has a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric; and wherein said pile strands comprise:

a plurality of tufts of fibers, each of said tufts of fibers having opposite ends with a loop portion located therebetween, said loop portion of each of said plurality of tufts being knitted together with a loop of said base fabric into said base fabric, said opposite ends of said plurality of tufts of fibers extending outwardly from said base fabric and forming part of the pile of said tubular knitted pile fabric sleeve;

a plurality of cut pile segments, each of said cut pile segments having opposite ends with a loop portion located therebetween, said loop portion of each of said plurality of cut pile segments being knitted together with a loop of said base fabric into said base fabric, said opposite ends of said plurality of cut pile segments extending outwardly from said base fabric and forming part of the pile of said tubular knitted pile fabric sleeve;

wherein said plurality of cut-pile segments and said plurality of tufts of sliver knit fabric are disposed in alternating successive courses in said tubular knitted pile fabric sleeve.

5. A sealed paint roller cover package as defined in claim 1, wherein said base fabric is knitted from a base strand, and wherein at least one of said base strand and said pile strands is made at least in part from a first material and a second material, wherein said first material has a lower melting point than said second material; and wherein said semi-rigid cylindrical core member comprises:

at least a portion of said first material that has been melted and has fused said base strand and said pile strands together to form said semi-rigid core member.

6. A sealed paint roller cover package as defined in claim 5, wherein the other of said base strand and said pile strands is made at least in part from a third material and a fourth material, wherein said third material has a lower melting point than said fourth material; and wherein said semi-rigid cylindrical core member comprises:

at least a portion of said first material and said third material that has been melted and has fused said base strand and said pile strands together to form said semi-rigid core member.

7. A sealed paint roller cover package as defined in claim 5, wherein said semi-rigid cylindrical core member additionally comprises:

one or more liquid adhesive materials that has been applied to an inside surface of said cylindrical core member and cured or dried to assist in forming said semi-rigid core member.

8. A sealed paint roller cover package as defined in claim 1, wherein said semi-rigid core member comprises:

one or more layers of a thin adhesive bonding material wound into a cylindrical configuration inside said cylindrical core member that has been melted and has fused within said cylindrical core member to assist in forming said semi-rigid core member.

9. A sealed paint roller cover package as defined in claim 8 wherein said base fabric is knitted from a base strand, and wherein at least one of said base strand and said pile strands is made at least in part from a first material and a second material, wherein said first material has a lower melting point than said second material; and wherein said semi-rigid cylindrical core member comprises:

at least a portion of said first material that has been melted and has fused said base strand and said pile strands together with said one or more layers of a thin adhesive bonding material to form said semi-rigid core member.

10. A sealed paint roller cover package as defined in claim 9, wherein the other of said base strand and said pile strands is made at least in part from a third material and a fourth material, wherein said third material has a lower melting point than said fourth material; and wherein said semi-rigid cylindrical core member comprises:

at least a portion of said first material and said third material that has been melted and has fused said base strand and said pile strands together with said one or more layers of a thin adhesive bonding material to form said semi-rigid core member.

11. A sealed paint roller cover package as defined in claim 1, wherein said plastic storage bag comprises:

a flat side wall and an opposed textured side wall having a network of shallow interconnected air channels located on a side of said textured side wall facing the flat side wall of the vacuum sealable plastic bag.

12. A sealed paint roller cover package as defined in claim 11, wherein said flat side wall and said opposed textured side wall are each of single layer construction.

13. A sealed paint roller cover package as defined in claim 11, wherein said flat side wall and said opposed textured side wall are each of multi-layer construction having an inner layer of heat-sealable material and an outer layer of gas impermeable material.

14. A sealed paint roller cover package as defined in claim 1, wherein said plastic storage bag is heat sealed.

15. A sealed paint roller cover package as defined in claim 1, additionally comprising:

one or more notches located in opposing side edges of said plastic storage bag to facilitate opening said sealed paint roller cover package to remove said paint roller cover therefrom.

16. A sealed paint roller cover package as defined in claim 1, wherein said plastic storage bag comprises a first side wall and an opposite second side wall, said sealed paint roller cover package additionally comprising:

a score line located in at least one of said first and second side walls of said plastic storage bag intermediate opposing side edges of said plastic storage bag.

17. A sealed paint roller cover package as defined in claim 1, wherein said plastic storage bag comprises a first side wall and an opposite second side wall, said sealed paint roller cover package additionally comprising:

a tear tape located in at least one of said first and second side walls of said plastic storage bag intermediate opposing side edges of said plastic storage bag.

18. A sealed paint roller cover package, comprising:

a paint roller cover comprising:

a tubular knitted pile fabric sleeve comprising a pile formed of pile strands knitted into and extending outwardly from a base fabric having a tubular configuration defining an outside and an inside; and one or more layers of a thin adhesive bonding material wound into a cylindrical configuration inside tubular knitted pile fabric sleeve that has been melted and has fused within said tubular knitted pile fabric sleeve to incorporate said base fabric therein and retains said pile strands thereto and thereby form said semi-rigid core member;

wherein said paint roller cover is semi-rigid such that it may be substantially flattened and subsequently resume a cylindrical configuration; and a flexible, gas-impermeable plastic storage bag of a size sufficient to receive said paint roller cover entirely therein, said plastic storage bag comprising:

a flat side wall; and an opposed textured side wall having a network of shallow interconnected air channels located on a side of said textured side wall facing the flat side wall of the vacuum sealable plastic bag;

wherein said plastic storage bag may be evacuated and heat sealed with said paint roller cover contained therein to cause said paint roller cover to be flattened such that said sealed paint roller cover package is substantially thinner than the diameter of said paint roller cover.

19. A sealed paint roller cover package, comprising:

a paint roller cover comprising:

a tubular knitted pile fabric sleeve comprising a pile formed of pile strands knitted into and extending outwardly from a base fabric having a tubular configuration; and a semi-rigid cylindrical core member formed inside said tubular knitted pile fabric sleeve, which core member incorporates said base fabric therein and retains said pile strands thereto, said paint roller cover being semi-rigid such that it may be substantially flattened; and a flexible, gas-impermeable plastic storage bag of a size sufficient to receive said paint roller cover entirely therein, said plastic storage bag being configured to be evacuated and sealed with said paint roller cover contained therein.

20. A method of making a sealed paint roller cover package, comprising:

providing a paint roller cover, said paint roller cover comprising;

a tubular knitted pile fabric sleeve comprising a pile formed of pile strands knitted into and extending outwardly from a base fabric having a tubular configuration defining an outside and an inside; and a semi-rigid cylindrical core member formed inside said tubular knitted pile fabric sleeve, which core member incorporates said base fabric therein and retains said pile strands thereto;

wherein said paint roller cover is semi-rigid such that it may be substantially flattened and subsequently resume a cylindrical configuration;

placing said paint roller cover in a flexible, gas-impermeable plastic storage bag of a size sufficient to receive said paint roller cover entirely therein;

evacuating said plastic storage bag with said paint roller cover contained therein to cause said paint roller cover to be flattened; and sealing said evacuated plastic storage bag with said flattened paint roller cover contained therein to thereby maintain said paint roller cover in its flattened configuration such that said sealed paint roller cover package is substantially thinner than the diameter of said paint roller cover.

* * * * *

UNITED STATES PATENT AND TRADEMARK OFFICE

CERTIFICATE OF CORRECTION

PATENT NO. : 8,181,490 B2
APPLICATION NO. : 12/698657
DATED : May 22, 2012
INVENTOR(S) : Daniel L. Sinykin It is certified that error appears in the above-identified patent and that said Letters Patent is hereby corrected as shown below:

On the Title Page Item (63) Related U.S. Application Data should read "Continuation-in-part of application No. 12/643,724, filed on Feb. 21, 2009, which is a continuation of application No. 12/371,009, filed on Feb. 13, 2009, now Pat. No. 7,634,724, which is a continuation-in-part of application No. 11/871,307, filed on Oct. 12, 2007, now Pat. No. 7,503,190, and a continuation-in-part of application No. 12/257,815, filed on Oct. 24, 2008, and a continuation-in-part of application No. 12/258,036, filed on Oct. 24, 2008, and a continuation-in-part of application No. 12/257,039, filed on Oct. 23, 2008, and a continuation-in-part of application No. 12/132,774, filed on Jun. 4, 2008, and a continuation-in-part of application No. 12/116,022, filed on May 6, 2008, now Pat. No. 7,748,980, application No. 12/698,657, which is a continuation-in-part of application No. 11/740,119, filed on Apr. 25, 2007, now Pat. No. 7,503,191, and a continuation-in-part of application No. 12/100,050, filed on Apr. 9, 2008, and a continuation-in-part of application No. 12/015,612, filed on Jan. 17, 2008, now Pat. No. 7,905,980, which is a continuation of application No. 11/871,307, which is a continuation-in-part of application No. 11/740,119." should read --Continuation-in-part of application No. 12/643,724, filed on Feb. 21, 2009, which is a continuation of application No. 12/371,009, filed on Feb. 13, 2009, now Pat. No. 7,634,921, which is a continuation of application No. 11/871,307, filed on Oct. 12, 2007, now Pat. No. 7,503,190, and a continuation-in-part of application No. 12/257,815, filed on Oct. 24, 2008, and a continuation-in-part of application No. 12/258,036, filed on Oct. 24, 2008, and a continuation-in-part of application No. 12/257,039, filed on Oct. 23, 2008, and a continuation-in-part of application No. 12/132,774, filed on Jun. 4, 2008, and a continuation-in-part of application No. 12/116,022, filed on May 6, 2008, now Pat. No. 7,748,241, which is a continuation-in-part of application No. 11/740,119, filed on Apr. 25, 2007, now Pat. No. 7,503,191, and a continuation-in-part of application No. 12/100,050, filed on Apr. 9, 2008, and a continuation-in-part of application No. 12/015,612, filed on Jan. 17, 2008, now Pat. No. 7,905,980, which is a continuation-in-part of application No. 11/740,119, filed on Apr. 25, 2007, now Pat. No. 7,503,191.--

On the Title page, Delete Item "(60) Provisional application No. 12/698,657."

Signed and Sealed this
Nineteenth Day of March, 2013

Teresa Stanek Rea

Teresa Stanek Rea
*Acting Director of the United States Patent and Trademark Office*